US007823573B2

(12) United States Patent
Anderson

(10) Patent No.: US 7,823,573 B2
(45) Date of Patent: Nov. 2, 2010

(54) GRIP FOR A PAINTBALL MARKER HAVING A REPLACEABLE INSERT

(76) Inventor: Kenneth K. Anderson, 1915 Yacht Maria, Newport Beach, CA (US) 92660

( * ) Notice: Subject to any disclaimer, the term of this patent is extended or adjusted under 35 U.S.C. 154(b) by 505 days.

(21) Appl. No.: 11/901,142

(22) Filed: Sep. 17, 2007

(65) Prior Publication Data

US 2009/0071460 A1 Mar. 19, 2009

(51) Int. Cl.
*F41B 11/00* (2006.01)

(52) U.S. Cl. ..... 124/74; 124/80

(58) Field of Classification Search ..... 124/1, 124/73, 74, 80; 446/473
See application file for complete search history.

(56) References Cited

U.S. PATENT DOCUMENTS 1,486,850 A * 3/1924 Avery et al. ..... 40/665
5,605,485 A * 2/1997 Spector ..... 446/72
5,609,507 A * 3/1997 Spector ..... 446/72
5,667,419 A * 9/1997 Spector ..... 446/72
6,120,346 A * 9/2000 Wang ..... 446/473
6,618,975 B1 * 9/2003 Shih ..... 42/75.03
7,654,020 B2 * 2/2010 Frederick ..... 40/306
2004/0194362 A1 * 10/2004 Chen ..... 40/628

* cited by examiner

*Primary Examiner*—John Ricci
(74) *Attorney, Agent, or Firm*—Morland C. Fischer

(57) ABSTRACT

A paintball marker of the kind used for propelling a paintball towards a target during the game of paintball. The paintball marker includes a handle to be grasped by the hand of a user during play. A comfortable grip is detachably connected to the handle and a replaceable insert is removably received within an insert opening through the grip. The replaceable insert has a particular color, indicia, and/or three-dimensional design to provide an ornamentally and visually distinctive grip to identify the user or represent his team. The insert can be quickly and easily separated from the grip to be replaced by a different insert having a different color, indicia, or design according to the needs of the user. Accordingly, the ornamentality of the grip of the paintball marker may be quickly and easily changed without having to replace the entire grip.

8 Claims, 3 Drawing Sheets

GRIP FOR A PAINTBALL MARKER HAVING A REPLACEABLE INSERT

BACKGROUND OF THE INVENTION

1. Field of the Invention

This invention relates to a grip that is detachably connected to the handle of a paintball marker of the kind used during the game of paintball to propel paintballs towards an intended target. The grip has a replaceable insert that may have a color, indicia, or three-dimensional design which identifies the paintball player or his team.

2. Background Art

The game of paintball is rapidly growing in popularity around the world. Participants use pressurized gas paintball markers to propel paintballs down a barrel system to be directed towards a target or each other. The paintball marker includes a handle that is grasped in the user's hand to aim the barrel system towards the intended target. A plastic grip is typically connected to each side of the handle. Such a plastic grip is relatively hard and is known to cause discomfort when the handle is tightly grasped in the user's hand for a long time.

In some cases, players have unique identities or achievements that they wish to be known to other players. In other cases, a player may be participating with a team of players that may wish to display their common identities by means of a particular color, logo, etc.

Currently, there is no easy way for a player to decorate his paintball marker to quickly and easily identify himself or his team to others. In this same regard, should a player change teams or should the individual player's status change, a means is lacking to provide a visible indication of the change to the player's paintball marker.

Therefore, what would be desirable is a lightweight, comfortable-to-hold grip for a handle of a paintball marker where the grip can be decorated to designate a particular player or a particular team of players and where the decoration can be quickly and easily changed.

SUMMARY OF THE INVENTION

In general terms, an improved grip is disclosed to be detachably connected to a handle of a paintball marker used to play the game of paintball. One such grip is located at each side of the handle. During play, the user grasps the handle and the grip thereof so that the barrel of the paintball marker can be aimed to propel a paintball towards an intended target. An insert opening is formed in the grip for receiving a removable grip insert that may be decorated with a color, indicia and/or a three-dimensional graphical design to provide a visible indication of the user, his achievements, or his team.

The grip is preferably manufactured from a relatively lightweight, non-metallic material to provide a relatively soft, comfortable surface for the hand of the user. By way of example, the grip may be made from a fiber-reinforced composite having non-metallic fibers embedded therewithin. The fiber-reinforced composite may be injection molded to form a grip having any desired size or shape to be detachably connected to the handle of the paintball marker. A groove or recess is formed in the back of the grip so as to extend around the insert opening in order to receive and releasably retain the removable insert therewithin without the need for traditional fasteners. In this manner, once the grip is disconnected from the handle, the grip insert can be easily removed and replaced with a different insert having a different decoration.

The grip insert is preferably manufactured by way of a conventional laminating process. By way of example, a relatively thin layer of fabric is laid over a thicker layer of foam. The fabric and foam are bonded together, and the resulting laminated grip insert is then colored, molded, or shaped to have a particular decoration that is unique to the user or his team. The decoration of the insert is visible to others through the insert opening in the grip in which the insert is removably received.

DESCRIPTION OF THE PREFERRED EMBODIMENT

Figure 1:
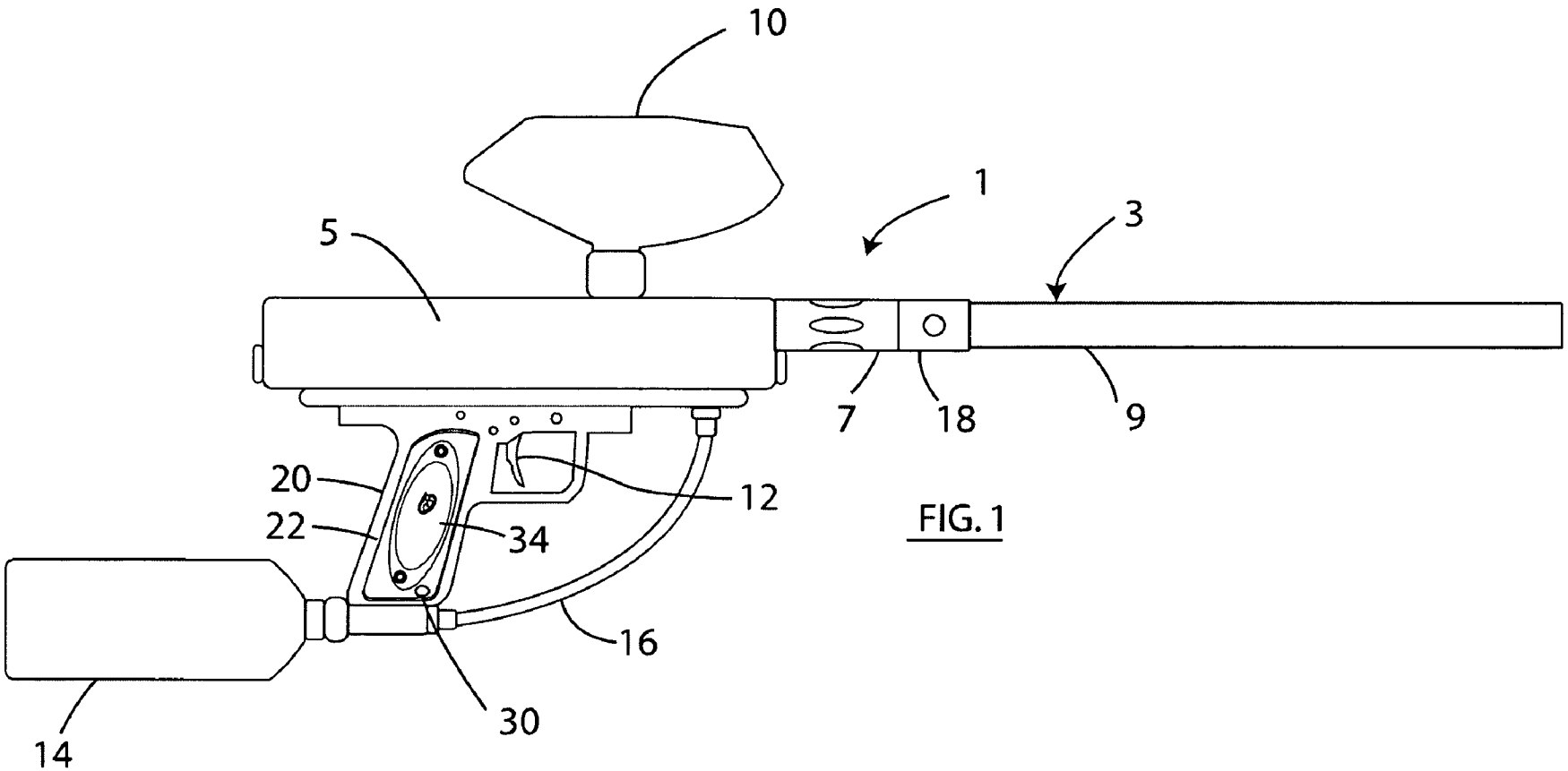
FIG. 1 shows a paintball marker including a grip detachably connected to one side of a handle of the paintball marker and having a removable grip insert according to a preferred embodiment of this invention.
Figure 2:
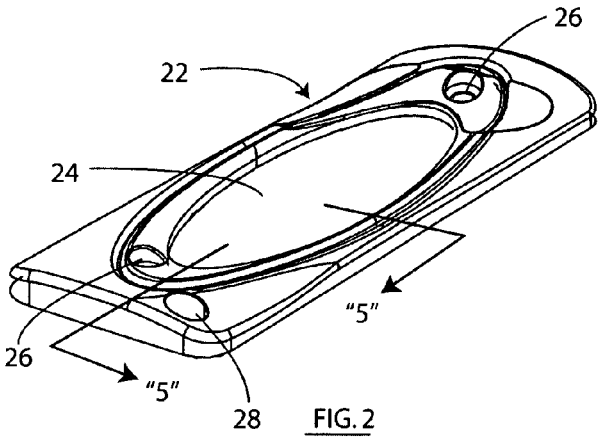
FIG. 2 is a perspective view of the grip disconnected from the handle of the paintball marker of FIG. 1 with the insert removed from the grip.
Figure 3:
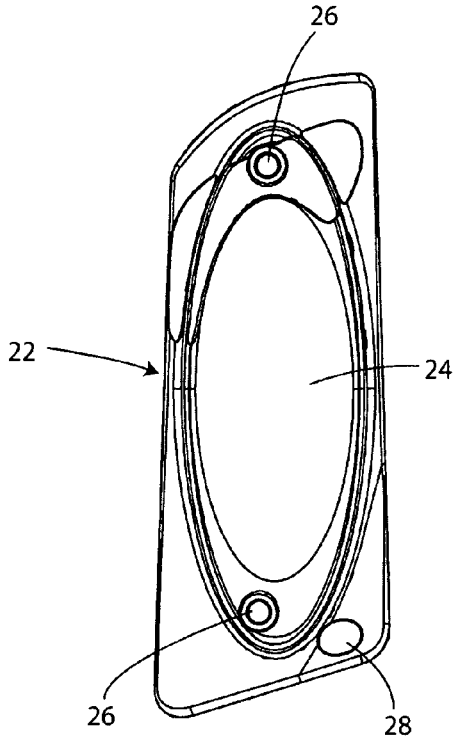
FIG. 3 shows the front of the grip of FIG. 2.

FIG. 1 of the drawings shows a paintball marker 1 having a barrel system 3 that is adapted to be removably connected to a body 5 of the paintball marker 1 to direct paintballs that are propelled therethrough towards an intended target. By way of particular example, the barrel system 3 of the paintball marker 1 of FIG. 1 includes a hollow breech 7 located at the rear end thereof and a hollow front or tip 9 located at the opposite end and coupled to the breech 7.

Like many paintball markers, the breech 7 of the barrel system 3 has a screw fitting (not shown) at the distal end thereof by which the breech can be removably connected to the body 5 of paintball marker 1. The breech 7 provides a controlled glide area that is sized to snuggly engage the paintballs being propelled through the barrel system 3 in order for the paintballs to build up speed. Therefore, the breech 7 is often interchangeable with other breeches having a variety of bore dimensions to correspond with different sizes of the paintballs to be loaded into the hopper 10.

A coupler 18 is located at the distal end of the front 9 of barrel system 3. The coupler 18 is provided with a screw fitting (also not shown) that is adapted to be mated to the proximal end of the breech 7 whereby the front 9 is detachably connected to the breech 7 to complete the barrel system 3 of the paintball marker 1. Like the breech 7 of barrel system 3, it may be desirable that the front 9 also be interchangeable with other fronts having a variety of bore dimensions depending upon the desired overall length of a barrel system and/or the size of the paintballs to be propelled through the barrel system. In some cases, the paintball marker may include a one-piece barrel system rather than the system 3 of FIG. 1 having a separate breech 7 and front 9.

The paintball marker 1 includes a handle 20 depending downwardly from the body 5. An improved grip 22 which forms the present improvement is shown detachably connected to one side of the handle 20. During play, the hand of a user (i.e., player) grasps the handle 20 and surrounds the grip 22 thereof so that the barrel assembly 3 can be aimed towards the intended target. As will now be explained, the detachable grip 22 carries a removable insert 34 that may be decorated in a variety of different ways to provide a visible indication as to the identity of the user or the user's team should he be engaged in team play. As will also be explained, insert 34 can be removed and replaced with a different insert having a different decoration should the player, his status, or his team change.

Turning to FIGS. 2-5 of the drawings, details are provided of one grip 22 from the handle 20 of the paintball marker 1 of FIG. 1. That is to say, the handle 20 will have a pair of grips 22 connected to opposite sides thereof. For purposes of convenience, only a single grip 22 will be disclosed herein. The grip 22 illustrated in the drawings has a rectangular configuration so as to be comfortably grasped in the hand of the user (i.e., player). An insert opening 24 is formed in the grip for the purpose of receiving a removable grip insert (designated 34 in FIG. 6). In the present example, the insert opening 24 is shown having an oval shape. However, it is to be understood that the grip opening 24 may have this or any other (e.g., circular, square, rectangular, etc.) suitable shape.

Holes 26 are formed through the top and bottom of the grip 22 to receive respective fasteners therethrough. In the present example, the holes 26 are located at opposite ends of the insert opening 24. In the assembled configuration of FIG. 1, the receipt of the fasteners through the holes 26 detachably connect the grip 22 to one side of the handle 20. In this same regard, the fasteners may be removed and the grip 22 separated from the handle 20 when it is desirable to substitute one grip insert for another.

An optional display opening 28 is formed through the grip 22 at a location which will be easily visible to the user. Opening 28 is sized to receive a light emitting diode (designated 30 in FIG. 1) or other visual display means. For those paintball markers so equipped, the (LED) display 30 will provide an indication whether the marker is off (at times of non-use) or otherwise on (at times when paintballs can be downloaded from the hopper 10 to be propelled through the barrel system 3).

Figure 5:
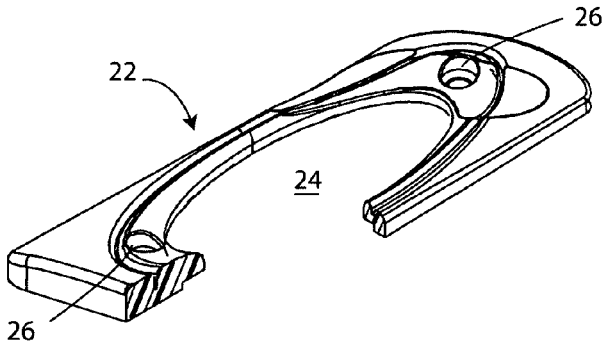
FIG. 5 is a cross section of the grip taken along lines 5-5 of FIG. 2.

According to a preferred embodiment, and as is best represented by FIG. 5, the grip 22 is manufactured from a lightweight, non-metallic material. By way of example only, the grip 22 is manufactured from a fiber-reinforced composite. A suitable composite for making grip 22 includes a plurality of non-metallic (e.g., glass, carbon, Kevlar, and the like) fibers embedded within a compatible (e.g., epoxy) resin. The grip 22 can be (e.g., injection) molded so as to have any desirable shape including insert opening 24 so as to be both aesthetically pleasing to the user and easily connected to the handle 20 of the paintball marker 1 of FIG. 1. What is more, the non-metallic grip 22 herein described will be softer and more comfortable to grasp than conventional grips typically manufactured from a relatively hard plastic material.

Figure 4:
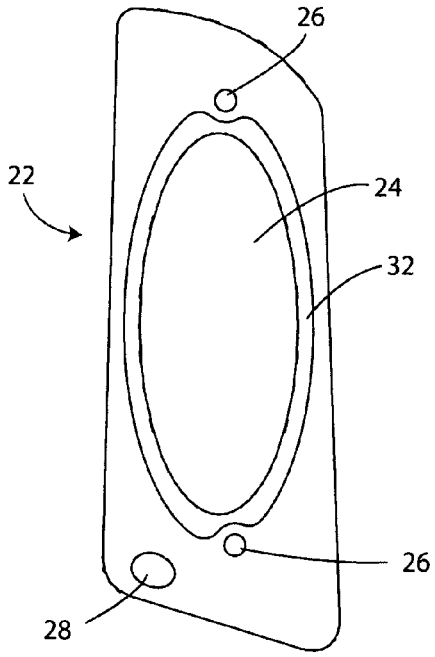
FIG. 4 shows the back of the grip of FIG. 2.

As is best shown in FIG. 4, a peripheral groove or recess 32 is formed (e.g., molded) in the back of grip 22 so as to surround the insert opening 24. The peripheral recess 32 has a size and shape adapted to accommodate therewithin a portion of the grip insert (designated 34 in FIG. 6), whereby the grip insert can be removably attached to and carried by the grip 22 in a manner that will now be disclosed.

Figure 6:
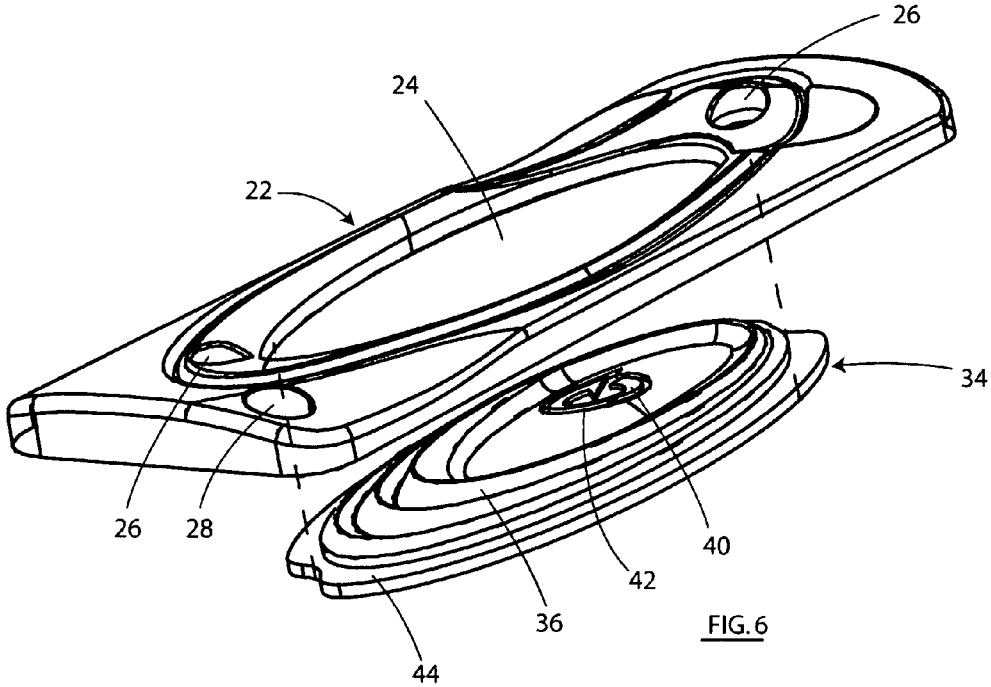
FIG. 6 is an exploded view showing the grip insert to be removably received by the grip of FIG. 4.

Referring to FIG. 6 of the drawings, there is shown the grip insert 34 to be removably attached to the grip 22 of FIGS. 2-5. According to a preferred embodiment, the grip insert 34 is manufactured from a laminated foam. By virtue of the foregoing, different grip inserts can be provided (e.g., embossed) with different ornamentally and visually distinctive decorations that are representative of and identify different players, teams of players, or their accomplishments. Once the grip 22 is detached from the handle 20 of the paintball marker 1 of FIG. 1, an existing grip insert can be removed therefrom to be quickly and easily replaced by another grip having different decorations depending upon the objectives of the user or his team.

Figure 7:
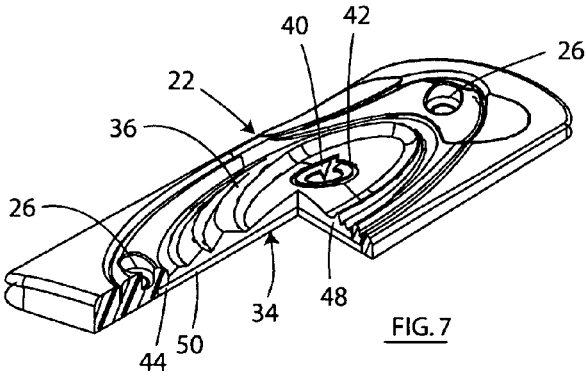
FIG. 7 is a cross section of the combination removable grip insert and detachable grip.
Figure 8:
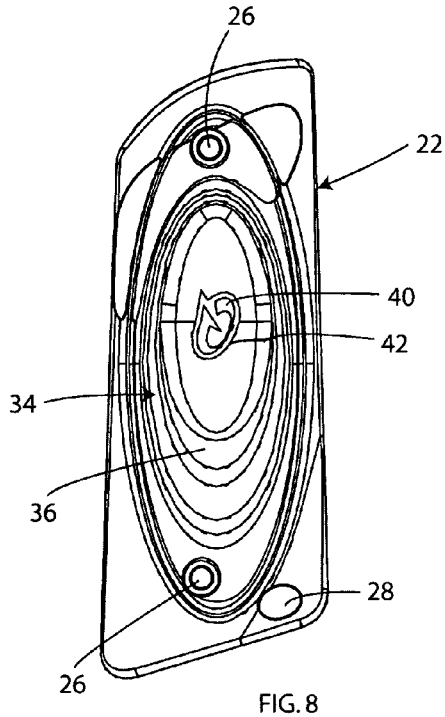
FIG. 8 is a front view of the combination removable grip insert and detachable grip.

To this end, the grip insert 34 herein disclosed includes a raised three-dimensional surface 36 that may have a particular color, indicia 40, and/or a graphical design 42 that is or are unique to and identify the user, his team, or their accomplishments. As is best shown in FIGS. 7 and 8 of the drawings, with the grip insert 34 removably attached to the grip 22, the raised surface 36 of insert 34 will be received in and project through the insert opening 24 of grip 22 to provide a visual and tactile display.

To enable the grip insert 34 to be removably attached to the grip 22 with the raised surface 36 of insert 34 projecting through the insert opening 24, the grip insert 34 is provided with a peripheral lip 44 (best shown in FIG. 6). The peripheral lip 44 surrounds the raised surface 36 of insert 34. In the grip assembly shown in FIGS. 7 and 8, the peripheral lip 44 is sized and shaped to be removably received within the peripheral recess 32 that is formed in the back of the grip 22 (best shown in FIG. 4) to surround the insert opening 24.

In other words, the replaceable grip insert 34 is releasably attached to and held in place against the grip 22 by means of a close-friction fit established between the peripheral lip 44 of insert 34 and the peripheral recess 32 of grip 22. Thus, fasteners are not required to hold insert 34 against the grip 22 so as to facilitate an easy substitution of one insert for another. Moreover, when it is desirable to change grip inserts, the existing insert 34 may be simply lifted off the grip 22 such that the lip 44 of insert 34 is pulled outwardly and separated from the recess 32 of grip 22. It may therefore be appreciated that the ornamentality and appearance of the grip 22 may be selectively changed on an as-needed basis without having to replace the entire grip.

It is contemplated that that replaceable grip insert 34 will be inexpensive to manufacture so as to be reused or simply discarded after use. By way of example, the grip insert 34 is preferably manufactured by subjecting a medium-density (e.g., EVA, polyethylene or polypropylene) foam to a conventional laminating process. More particularly, a thin layer of fabric 48 (e.g., such as that known commercially as Lycra) that is resistant to abrasion and able to be stretched is laid over a thicker layer of foam 50. Heat and pressure are then applied during a compression-forming step to create a laminated grip insert 34 with the thin layer of fabric 48 bonded to and covering the thick layer of foam 50. The layer of fabric 48 may be colored or provided with graphics. The completed laminated grip insert 48 may also be molded or shaped to include the three-dimensional raised surface 36 earlier described.

The invention claimed is:

1. A paintball marker comprising a barrel to receive a paintball to be propelled down the barrel towards a target, a grip to be grasped in the hand of a user to aim the barrel, and a visually-accessible insert removably attached to said grip such that said insert can be removed from said grip to be replaced by a different visually-accessible insert, said grip having an insert opening extending therethrough and a recess formed in said grip and lying adjacent said insert opening, said insert being removably attached to said grip within said insert opening and said recess thereof.

2. The paintball marker recited in claim 1, wherein said visually-accessible insert has a raised surface and a lip extending around and lying below said raised surface, said raised surface being removably received within the insert opening of said grip and said lip being removably received within the recess of said grip.

3. The paintball marker recited in claim 2, wherein the lip of said visually-accessible insert is frictionally engaged within the recess of said grip, whereby said insert is removably attached to said grip without the use of fasteners.

4. The paintball marker recited in claim 2, wherein the raised surface of said visually-accessible insert forms a three-dimensional design.

5. The paintball marker recited in claim 2, wherein the raised surface of said visually-accessible insert contains indicia.

6. The paintball marker recited in claim 1, wherein said visually-accessible insert includes a layer of fabric lying over and bonded to a layer of foam.

7. The paintball marker recited in claim 1, wherein said grip is manufactured from a fiber-reinforced composite having non-metallic fibers embedded within a resin.

8. For a paintball marker adapted to propel paintballs towards a target and having a grip to be grasped in the hand of a user, the improvement of a visually-accessible insert removably attached to the grip such that said insert can be removed from said grip to be replaced by a different visually-accessible insert, said grip having an insert opening extending therethrough, and said visually-accessible insert being removably attached to said grip so as to be located within and project through said insert opening thereof.

* * * * *